US006142845A

United States Patent [19]

Feldman

[11] Patent Number: 6,142,845

[45] Date of Patent: Nov. 7, 2000

[54] TWIRLING DOLL HAVING BUBBLE WAND ATTACHMENTS

[75] Inventor: Joseph Feldman, Los Angeles, Calif.

[73] Assignee: Mattel, Inc., El Segundo

[21] Appl. No.: 09/365,523

[22] Filed: Aug. 2, 1999

[51] Int. Cl.[7] ..... A63H 33/28

[52] U.S. Cl. ..... 446/15; 446/16; D21/401; 40/419

[58] Field of Search ..... 446/330, 236, 446/15, 16; D21/401, 402; 40/418, 419, 406, 407, 408

[56] References Cited

U.S. PATENT DOCUMENTS

| | | | |
|---|---|---|---|
| D. 366,075 | 1/1996 | Bhandhugravi et al. | D21/159 |
| D. 385,588 | 10/1997 | Cohen | D21/61 |
| 660,485 | 10/1900 | Bradshaw | 40/419 |
| 721,787 | 3/1903 | Dorment | 40/419 |
| 1,287,328 | 12/1918 | Jafferian . | |
| 1,584,979 | 5/1926 | Clausen . | |
| 1,776,964 | 9/1930 | Aznak et al. . | |
| 2,533,935 | 12/1950 | Herzog . | |
| 2,829,467 | 4/1958 | Pagano . | |
| 3,745,693 | 7/1973 | La Fata et al. | 446/15 |
| 3,950,887 | 4/1976 | Kort | 446/15 |
| 4,112,613 | 9/1978 | Toplak . | |
| 4,339,889 | 7/1982 | Guerrero et al. . | |
| 4,391,064 | 7/1983 | Lakin et al. | 446/15 |
| 4,413,441 | 11/1983 | Hunter et al. | 446/15 |
| 4,957,464 | 9/1990 | Perez | 446/16 |
| 5,102,381 | 4/1992 | Daniel et al. . | |
| 5,183,428 | 2/1993 | Lin | 446/15 |
| 5,224,893 | 7/1993 | Routzong et al. | 446/15 |
| 5,238,437 | 8/1993 | Vowles et al. | 446/15 |
| 5,297,979 | 3/1994 | Amron | 446/16 |
| 5,348,507 | 9/1994 | McGhie et al. . | |
| 5,525,086 | 6/1996 | Gentile et al. . | |
| 5,603,651 | 2/1997 | Shure et al. | 446/16 |
| 5,695,379 | 12/1997 | Ho . | |

*Primary Examiner*—Jacob K. Ackun
*Assistant Examiner*—Bena B. Miller
*Attorney, Agent, or Firm*—Roy A. Ekstrand

[57] ABSTRACT

A doll includes a doll body having a torso rotatably supported upon the legs and lower body of the doll. The torso supports a pair of arms which in turn support a pair of bubble attachment. Each bubble attachment is snap-fit attached to the doll's arms and includes a conventional bubble ring. A pullstring mechanism is operative within the doll body and torso to provide rotation of the torso and arms of the doll back and forth in response to pullstring draw and release. A quantity of bubble-producing liquid is loaded upon the bubble attachments afterwhich the pullstring operation twirls the doll torso and arm to produce a number of bubbles.

12 Claims, 3 Drawing Sheets

TWIRLING DOLL HAVING BUBBLE WAND ATTACHMENTS

FIELD OF THE INVENTION

This invention relates generally to dolls and particularly to those which utilize a bubble-producing feature.

BACKGROUND OF THE INVENTION

Dolls have become a substantial segment of the toy industry. Having evolved from early often crude and home-made items, dolls have steadily grown in variety, complexity and play value. Notsurprisingly, practitioners in the art have responded to this long term growing popularity by producing a wide variety of dolls. Thus, dolls have been provided in a virtually endless variety and have included dolls which either participate in or simulate human-like activities of walking, talking, eating or sleeping.

In addition, dolls have also been provided which participate in activities such as swimming, skating and other sports. With the advent of miniature low cost electronic components, dolls have been fabricated which exhibit a high degree of complexity and capability. Still other dolls have been fabricated which continue to rely upon and expand the use of less sophisticated technologies such as spring-driven or pullstring-driven actions to produce surprisingly entertaining and amusing dolls.

For example, U.S. Pat. No. 5,525,046 issued to Gentile, et al. sets forth a LAUNCHABLE FIGURING DEVICE having a figurine supporting wings capable of aerodynamic lift upon rotation of the figurine. A rotation imparting mechanism is releasibly mated with the figurine to provide the requisite rotational velocity for launching the figure into the air. The rotation imparting mechanism is releasibly mated with the figurine to provide the requisite rotational velocity for launching the figure into the air. The rotation imparting mechanism utilizes a rotating drum and gear drive energized by a pullstring device.

U.S. Pat. No. 1,287,328 issued to Jafferian sets forth a DOLL illustrative of an early form of twirling doll. A doll body defines an interior cavity and supports an elongated rotatable element extending head to toe of the toy figure. The rotating element supports the doll head in rotational attachment with respect to the doll body. An aperture is formed in the doll body through which a quantity of string is passed and is wound upon the rotatable element. As the user holds the doll body firmly and rapidly draws the string outwardly, the doll head is rapidly rotated.

U.S. Pat. No. 4,391,064 issued to Lakin et al. sets forth an ACROBATIC TOY for use in child's crib or playpin. The toy includes a figure suspended from a rotatable main shaft in order to simulate acrobatic movements. The figure is suspended by a pair of arms which are fixed to the main shaft and pivotally connected to the body of the figure. The toy is hung from the crib and operated by a pull-string mechanism having a ring and cord.

U.S. Pat. No. 4,112,613 issued to Toplak sets forth a SPINNING TOY having a flying top and elongated lower portion for winding a string thereon. An enlarged upper portion is provided with wings for flying the top upon rapid unwinding of the string.

U.S. Pat. No. 2,533,935 issued to Herzog sets forth a CORD ACTUATED SPINNING TOY having a base, an elongated shaft rotatable therein and a figure supported on the upper end of the shaft. A pull-string mechanism is supported at the approximate mid point of the shaft and is used to impart a twirling action to the shaft and toy figure.

U.S. Pat. No. 2,829,467 issued to Pagano sets forth a TWO WHEELED GYRO CONTROLLED MOTORCYCLE having an inertial drive motor and gyro combination operated by a pull-string energizer.

U.S. Pat. No. 1,584,979 issued to Clausen sets forth a GYROSCOPIC TOY having a toy figure supporting a horizontally oriented rotatable gyroscope in a simulated skirt therein. A pull-string mechanism is operative in impart motory motion to the gyroscope causing the toy to whirl in a stablized manner.

U.S. Pat. No. 1,776,964 issued to Aznak et al. sets forth a TOY having a toy body rotatably supported upon a pair of feet and having a rotatably supported head. The head and feet are joined by a common shaft which includes a pull-string mechanism for imparting rotary motion to the head and feet.

U.S. Pat. No. 4,339,889 issued to Guerrero et al. sets forth a MULTIPLE FUNCTION DOLL and U.S. Pat. No. 4,413,441 issued to Hunter et al. sets forth a MULTIPLE FUNCTION DOLL both of which utilize a pull-string motor as a moving source.

In a related art, various toys have been provided which utilize bubble production or bubble play activity as a part of their interest and appeal. Thus, for example, U.S. Pat. No. 5,238,437 issued to Vowles, et al. sets forth a BUBBLE DISENSING DOLL including a hollow torso and head configured to resemble a mermaid. The doll head supports a quantity of simulated hair and a headpiece ornament preferably formed in the configuration of a crown or the like. A battery-driven electrically powered bubble-producing mechanism is formed within the doll's head. A foaming chamber within the bubble-producing mechanism creates an upwardly directed stream of bubbles which emerge from the doll head and simulated hairpiece ornament.

U.S. Pat. No. 5,695,379 issued to Ho sets forth a BUBBLE-PRODUCING TOY having a handheld device comprising a handle and bubble generating means capable of producing different sizes of bubbles when being swung around through the air or having air directed against the bubble generating means.

U.S. Pat. No. 5,224,893 issued to Routzong, et al. sets forth a BUBBLE-PRODUCING TOY which resembles a spinning baton. The toy includes a handle and cross member rotatably member on the handle. A bubble solution is stored in a hub reservoir and a bubble diffuser is attached to the outer end of the baton. As the baton is whirled the bubble diffuser creates a stream of bubbles.

U.S. Pat. No. 3,745,693 issued to left, et al. sets forth a SWING-AROUND BUBBLE-MAKING TOY having a bubble-producing device secured to an elongated flexible cord which in turn is secured to a handle grip. As the device is held by the handle grip and twirled about the user in a circular arc, air passes through the device producing a stream of trailing bubbles.

U.S. Pat. No. 5,102,381 issued to Danielle, et al. sets forth a BUBBLE-PRODUCING JUMPROPE having a pair of handle grips and an elongated flexible jumprope couple therebetween. A pair of bubble-producing devices a secured to intermediate portions of the flexible jumprope and produce a stream of bubbles as air passes through the bubble devices during jumprope activity.

U.S. Pat. No. 5,348,507 issued to McGhie, et al. sets forth a BICYCLE BUBBLE TOY having an elongated housing attachable to the handlebar of a bicycle to extend the housing outwardly from the handlebars. The extending housing supports a rotatable fan which in turn is coupled to a plurality of rotatable bubble-blowing rings. As the bicycle moves through the air, the passing air rotates the fan and bubble rings through a bubble solution reservoir and into the stream of passing air thereby producing bubbles.

U.S. Pat. No. 5,603,651 issued to Shure, et al. sets forth a BUBBLE-PRODUCING SKIPPING TOY having a rod or tether supporting a circular ring at one end to loosely encircle the user's lower leg or ankle. A bubble-producing mechanism is secured to the outer end of the rod and is operative to produce bubbles when twirled about the user's leg.

While the foregoing described prior art devices have improved the art and in some instances have enjoyed commercial success, their remains nonetheless a continuing need in the art for evermore interesting, cost effective and amusing dolls which utilize a bubble-producing activity to enhance play value.

SUMMARY OF THE INVENTION

Accordingly, it is a general object of the present invention to provide an improved doll. It is a more particular object of the present invention to provide an improved doll which utilizes a twirling feature for enhanced amusement value. It is a still more particular object of the present invention which combines the amusement of a twirling doll with the excitement of a bubble play activity.

In accordance with the present invention, there is provided a doll comprising: a lower body; a torso rotatably coupled to the lower body; a pair of arms supported by the torso; a pair of bubble attachments, each having a bubble ring defining an aperture, the bubble attachments supported by the pair of arms; means for rotating the torso, the arms and the bubble attachments upon the lower body, the bubble attachments being configured to carry a quantity of bubble-producing liquid and to create bubbles as air passes over them.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
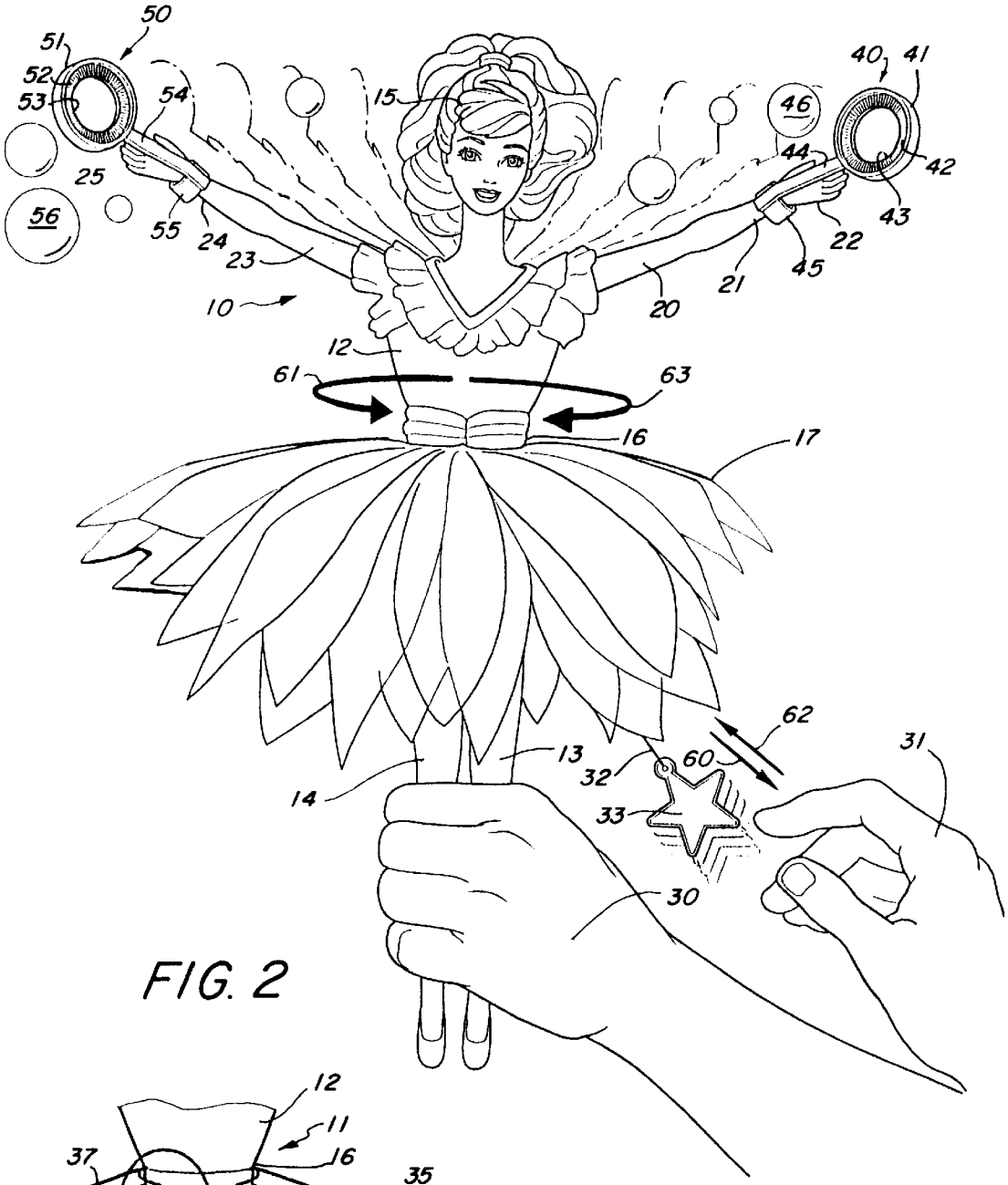
FIG. 1 sets forth a front view of a doll constructed in accordance with the present invention illustrating the twirling bubble-producing activity thereof.

FIG. 1 sets forth a front view of a twirling doll constructed in accordance with the present invention and generally referenced by numeral 10. Doll 10 includes a doll body 11 having a torso 12 and a pair of supporting legs 13 and 14. As is better seen in FIG. 2, legs 13 and 14 are coupled to torso 12 by a lower body 26. Torso 12 further supports a pair of arms 20 and 23. Arms 20 and 23 are pivotally supported upon torso 12 in the manner shown below in FIG. 3. Arm 20 defines a wrist 21 and a hand 22 while arm 23 defines a wrist 24 and a hand 25. A head 15 is supported upon torso 12 and a skirt 17 is supported upon a waist 16 of doll body 11. The remainder of doll body 11 is covered with a suitable clothing garment.

In accordance with the present invention, a pair of bubble attachments 40 and 50 are secured to arms 20 and 23 respectively. Bubble attachment 40 includes an annular bubble ring 41 having a plurality of radially extending ribs 42 and a large center aperture 43. Bubble attachment 40 further includes an elongated rigid link 44 and a clasp 45. Clasp 45 is preferably formed of a somewhat resilient material such as molded plastic or the like and is snap-fitted to wrist 21 in a snap-fit attachment illustrated in FIG. 3. Link 44 supports bubble ring 41 somewhat beyond hand 22.

Similarly, bubble attachment 50 includes an annular bubble ring 51 having radially extending ribs 52 and an aperture 53. A clasp 55 snap-fits to wrist 24 of arm 23 and a link 54 joins bubble ring 51 to clasp 55. In the preferred fabrication of the present invention, bubble attachments 40 and 50 are formed as a single integral molded plastic unit. However, other materials may be used to fabricate bubble attachments 40 and 50 without departing from the spirit and scope of the present invention.

By means set forth below in greater detail, torso 12 is rotatably supported upon legs 13 and 14 and lower body 26 (seen in FIG. 2). By means also set forth below in greater detail, a pullstring mechanism having a pullstring 32 is operative within doll body 11. The outer end of pullstring 32 is secured to a grip 33. The shape of grip 33 is selected from virtually any aesthetically pleasing shape with the essential function of providing an enlarged member by which the end of pullstring 32 may be gripped.

In operation and by means described below in greater detail, the user grasps doll body 11 at a convenient point beneath waist 16 such as shown in FIG. 1 in which a hand 30 holds legs 13 and 14. Thereafter, the user's other hand 31 holds grip 33 and draws pullstring 32 outwardly in the direction indicated by arrow 60. As the user draws pullstring 32 in the direction of arrow 60, torso 12 together with arms 20 and 23, head 15 and bubble attachments 40 and 50 rotates about waist 16 in the direction indicated by arrow 61. Once pullstring 32 has been fully drawn, the user allows the return spring (seen in FIG. 5) within doll body 11 to rewind the pullstring mechanism. Thus, the user allows grip 33 and pullstring 32 to be retracted in the direction indicated by arrow 62. By means set forth below in greater detail, the spring force retracting pullstring 32 also rotates torso 12 together with arms 20 and 23 and head 15 as well as bubble attachments 40 and 50 in the direction indicated by arrow 63.

Thus, as the user develops timing in drawing pullstring 32 outwardly and then allowing pullstring 32 to be rewound, the upper portion of doll body 11 together with bubble attachments 40 and 50 are rotated back and forth in a twirling action. In accordance with an important aspect of the present invention and as is set forth below in FIG. 4, the user initially immerses bubble ring 41 of bubble attachment 40 and bubble ring 51 of bubble attachment 50 in a bubble liquid such as bubble liquid 71 shown in FIG. 4. As a result, a bubble solution film is formed which spans apertures 43 and 53. In addition and in accordance with conventional functioning of bubble rings such as bubble rings 41 and 51, a quantity of bubble solution is retained upon ribs 42 and 52. Thereafter, with bubble attachments 40 and 50 suitably primed, the user undertakes the above-described play pattern of pulling and releasing pullstring 32. As arms 20 and 23 twirl and rotate, the air movement through apertures 43 and 53 of bubble rings 41 and 51 produce streams of bubbles such as bubbles 46 and 56.

Once the user acquires some familiarity and skill in manipulating doll 10, a very dramatic and exciting play pattern evolves in which a substantial stream of bubbles is produced which tends to accumulate about the upper portion of doll 10. In this manner, an exciting and amusing appearance is provided in which the doll appears to be producing a fanciful stream of bubbles as it moves about.

It will be apparent to those skilled in the art that the twirling action of the present invention doll set forth below is provided by a pullstring drive arrangement. However, it will be equally apparent to those skilled in the art that this mechanism for rotating the doll torso upon the doll lower body is the preferred embodiment of the present invention but that the invention is not limited thereto. Thus, the invention contemplates other types of drive mechanisms such as battery-powered electric motor drives, wind-up spring-driven mechanisms or simple freely rotating mechanisms to name but a few examples. The important aspect of the present invention is the provision of a doll with a twirling upper torso supporting a plurality of bubble-producing rings to provide the inventive play pattern. It will also be apparent to those skilled in the art that other types of bubble-producing attachments may be utilized and may, if desired, be secured to the doll's arms in different manners such as integrally forming them therewith should the user desire.

Figure 2:
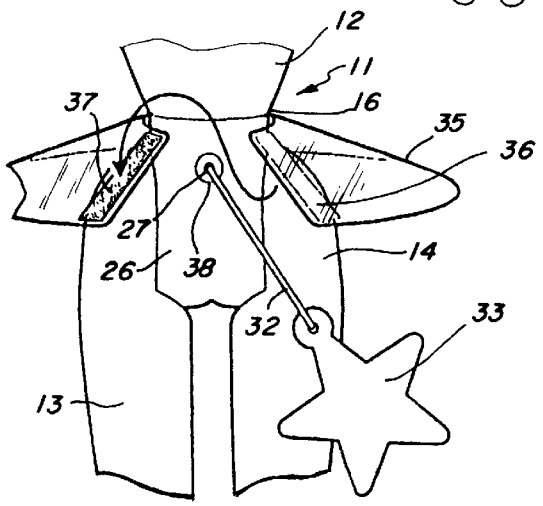
FIG. 2 sets forth a partial assembly view of a portion of the present invention doll.

FIG. 2 sets forth a partial assembly view showing a skirt support 35 being assembled to the doll waist. By way of overview, skirt support 35 is formed of a rigid material and is supported beneath skirt 17 to ensure that skirt 17 flares outwardly as opposed to draping downwardly. This outward skirt flaring has been found additionally attractive and is helpful in aiding the user in gripping the lower body of the present invention doll during the bubble twirling process.

More specifically, doll 10 includes a doll body 11 having an upper torso 12, a waist 16 and a lower body 26. By means described below in FIG. 5, lower body 26 and torso 12 are rotationally coupled. Lower body 26 supports legs 13 and 14 in the manner described below. An eyelet 38 is supported within lower body 26 and defines an aperture 27. A pullstring 32 passes into doll body 11 via aperture 27 of eyelet 38. Pullstring 32 supports a grip 33 at its outer end. A skirt support 35 preferably formed of a relatively rigid material such as thin plastic or the like defines a frusto-conical member having attachment pads 36 and 37 which facilitate assembly of skirt support 35 to waist 16 as shown. It will be apparent to those skilled in the art that a variety of attachment elements may be utilized to secure skirt support 35 such as metallic snaps or cooperating snap-fit attachments. However, in the embodiment shown in FIG. 2, attachment pads 36 and 37 comprise hook and loop fabric attachment pads.

Figure 3:
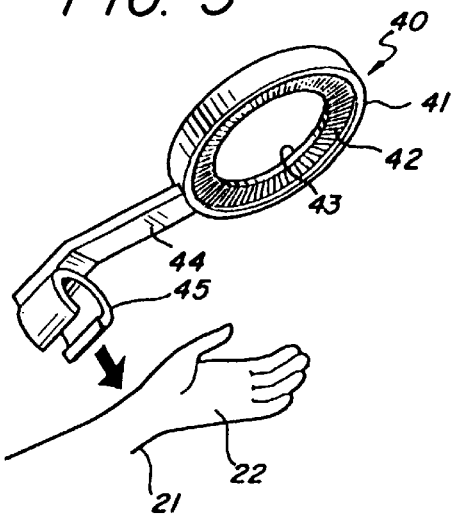
FIG. 3 sets forth a perspective assembly view of the hand attachment bubble ring of the present invention twirling doll.

FIG. 3 sets forth a partial assembly view of bubble attachment 40 and arm 20. It will be understood that the assembly of bubble attachment 40 to arm 20 described in conjunction with FIG. 3 is substantially the same as the assembly of bubble attachment 50 to arm 23 (seen in FIG. 1). Thus, the descriptions of bubble attachment 40 and arm 20 described in FIG. 3 apply equally well to bubble attachment 50 and arm 23.

As described above, bubble attachment 40 includes an annular bubble ring 41 having a plurality of radially extending ribs 42 and a center aperture 43. A clasp 45 is preferably formed of a resilient material such as molded plastic and is snap-fit assembled to wrist 21 of arm 20 beneath hand 22. A link 44 joins clasp 45 to bubble ring 40. The removal of bubble attachment 40 is carried forward in the reverse manner by simply forcing clasp 45 away from wrist 21 during which time the resilient material of clasp 45 expands to allow removal.

Figure 4:
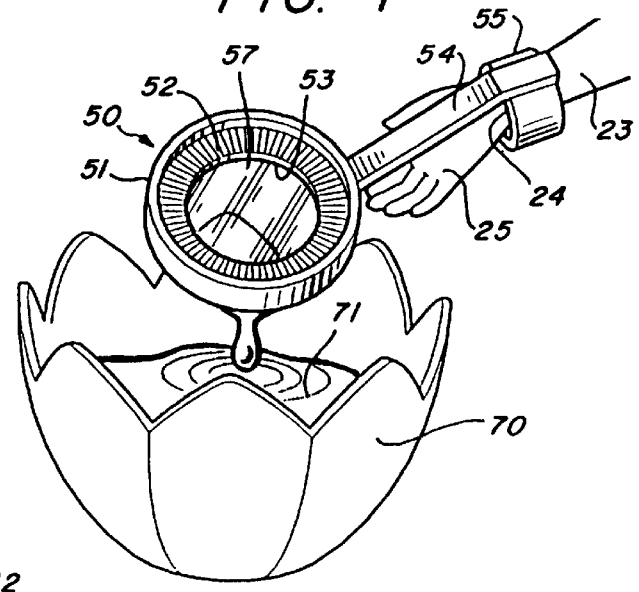
FIG. 4 sets forth a perspective view of the hand attachment bubble ring and bubble solution reservoir of the present invention doll.

FIG. 4 sets forth a partial perspective view of the bubble liquid loading process used to prepare the bubble attachments of the present invention doll for the above-described bubble-producing play pattern. A cup 70 supports a quantity of bubble liquid 71 in an open container. Arm 23 having wrist 24 and hand 25 is assembled to bubble attachment 50 in snap-fit assembly described above. As is also described above, bubble attachment 50 defines an annular bubble ring 51 having an aperture 53 and a plurality of radially extending ribs 52. A link 54 joins bubble ring 51 to clasp 55. In the loading process shown in FIG. 4, the user dips bubble ring 51 into bubble liquid 71 to transfer a quantity of bubble liquid to bubble ring 51. The characteristic of bubble liquid 71 allows the formation of a film 57 of the bubble liquid to span aperture 53. In addition, the characteristic of ribs 52 aids bubble ring 51 in retaining a substantial quantity of bubble liquid 71 upon the rib surfaces. Once bubble attachment 50 has been loaded in the manner shown in FIG. 4, a similar process is repeated for bubble attachment 40 (seen in FIG. 3). Thereafter, the present invention doll is utilized in the manner described in FIG. 1 to provide the bubble-producing play pattern. Once the quantity of liquid in the bubble rings has been depleted, the process shown in FIG. 4 is repeated as many times as desired.

Figure 5:
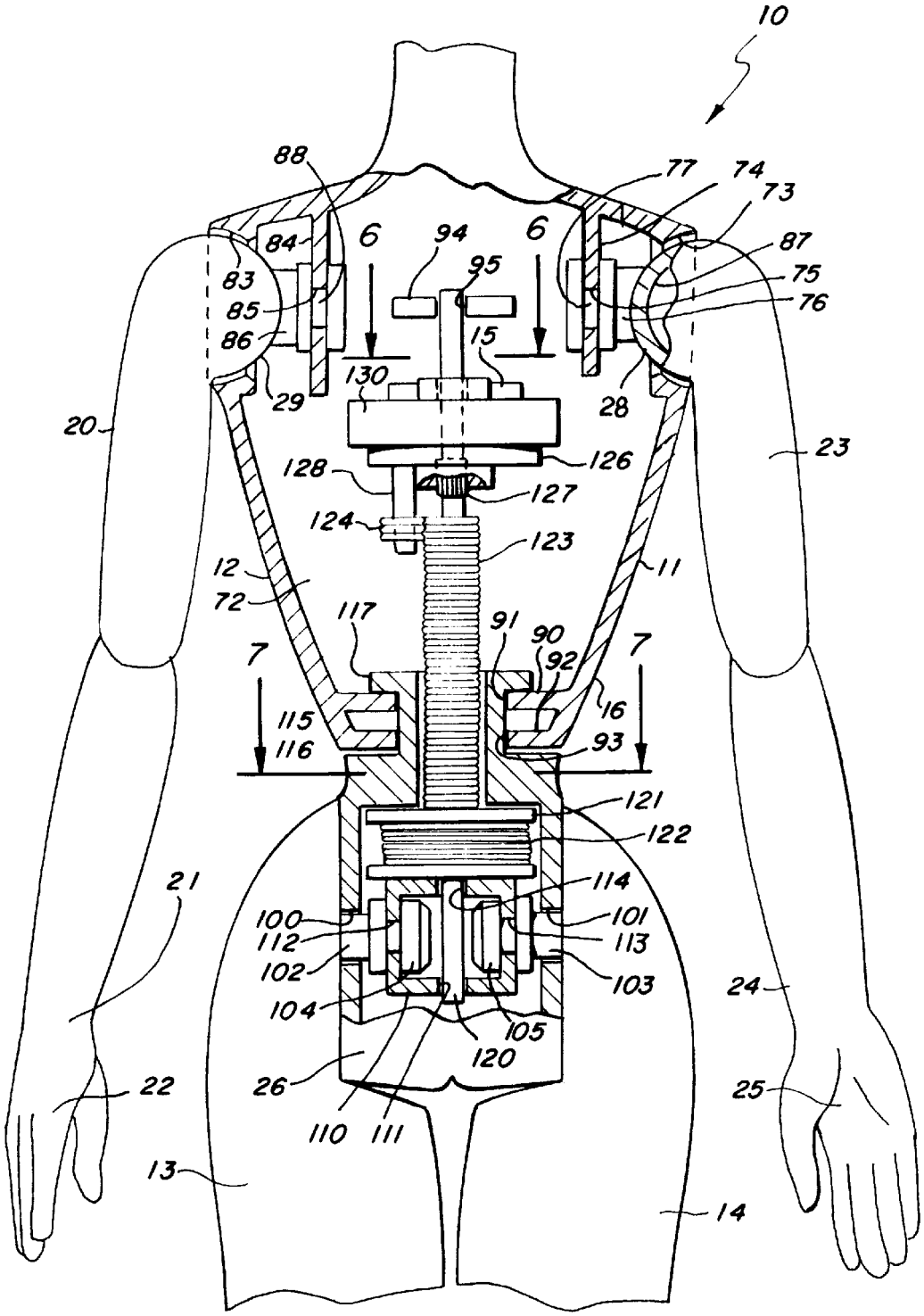
FIG. 5 sets forth a partial section rear view of the operative mechanism of the present invention twirling doll.

FIG. 5 sets forth a partial section rear view of doll 10 showing the operative mechanism for the pullstring twirling action described in FIG. 1. It will be recalled with temporary reference to FIG. 2 that pullstring 32 extends outwardly from lower body 26 through an eyelet 38. It will be further noted that the section view shown in FIG. 5 does not show this structure. Thus, for purposes of illustration, a quantity of pullstring wound upon spool 121 is illustrated.

More specifically, doll 10 includes a doll body 11 having a torso 12 which defines an interior cavity 72. Torso 12 further defines a pair of shoulder sockets 73 and 83 together with a pair of bearing journals 74 and 84. Journals 74 and 84 define respective apertures 75 and 85 generally aligned with sockets 73 and 83. To facilitate positioning of the present invention doll arms in a variety of positions, doll arms 20 and 23 are pivotally supported within sockets 83 and 73 respectively. Thus, arm 20 includes a ball end 29 received within socket 83 while arm 23 includes a ball end 28 received within socket 73. As described above, arms 20 and 23 define respective wrists 21 and 24 and respective hands 22 and 25. Arm 23 includes a post 76 extending from ball end 28 which in turn includes a bearing 77 rotatably supported within aperture 75. Post 76 is joined to a movable support 87 which is received within ball end 28 in a manner facilitating the pivotal movement of ball end 28. Thus, arm 23 is movable in front to back as well as up and down pivotal movement directions.

Arm 20 is similarly secured within socket 83 by a post 86 having a bearing 88. Bearing 88 is rotatably supported within aperture 85 of bearing journal 84. While not seen in FIG. 5, it will be understood that post 86 is pivotally secured to ball end 29 by a similar structure to that shown for post 76 and ball end 28 of arm 23. Thus, arm 20 is similarly movable in either front to back or up and down pivotal movements.

Torso 12 further defines a pair of inwardly extending webs 90 and 92 defining respective apertures 91 and 93 therein. Apertures 91 and 93 are concentric and are of the same size to provide an effective passage between webs 90 and 92.

Lower body 26 defines a pair of side apertures 100 and 101 together with an internal box support member 110. Box support member 110 defines a pair of side apertures 112 and 113 generally aligned with apertures 100 and 101 respectively. Box support 110 further defines a lower aperture 111 and an upper aperture 114 in vertical alignment. The upper portion of lower body 26 defines a generally cylindrical sleeve 115 which passes through apertures 91 and 93 of webs 90 and 92. An extending lip 117 is formed at the upper end of sleeve 115 to captivate lower body 26 in a rotational attachment to the lower end of torso 12. Thus, lower body 26 and torso 12 are joined in a rotational attachment which facilitates the rotation of torso 12 with respect to lower body 26.

Sleeve 115 further defines a bore 116 extending upwardly beyond lip 117. An elongated shaft 120 is received within apertures 111 and 114 of box 110 and extends upwardly through bore 116 into interior cavity 72 of torso 12. Shaft 120 further extends into torso 12 and is rotatably supported at its uppermost end within a notch 95 formed in a supporting flange 94 secured to torso 12. Thus, shaft 120 is rotatably supported within doll body 11.

Figure 7:
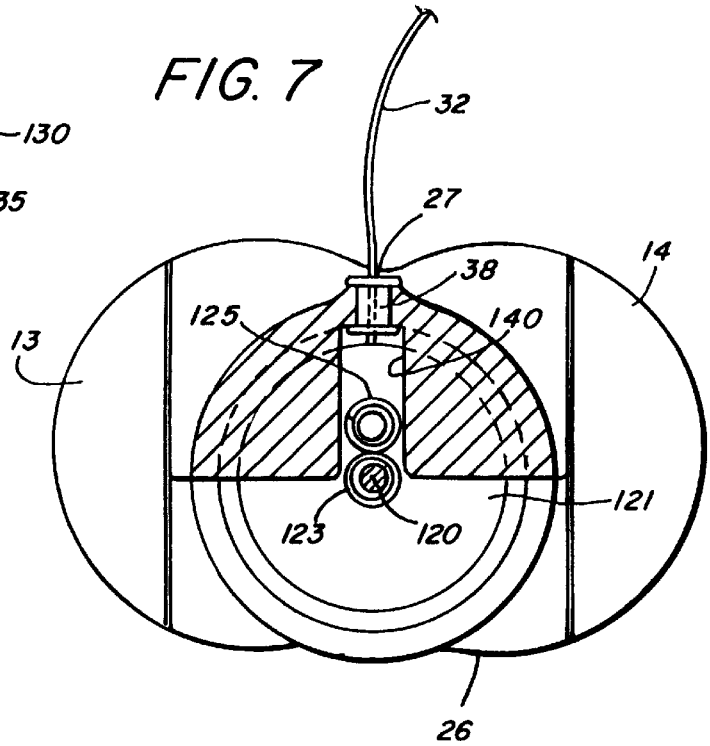
FIG. 7 sets forth a section view of the present invention twirling doll taken along section lines 7—7 in FIG. 5.

In further accordance with the present invention, a spool 121 is received upon and secured to shaft 120. In accordance with the operative mechanism of the present invention, pullstring 32 extends into lower body 26 in the manner shown in FIG. 2. In further accordance with the present invention operative mechanism, a quantity of pullstring is wound upon spool 121 forming a portion of wound pullstring 122 thereon. While not seen in FIG. 5, it will be understood that wound pullstring 122 is joined to the remainder of pullstring 32 extending outwardly through lower body 26 in the manner shown in FIG. 2. An elongated coil spring 123 is received upon shaft 120. Spring 123 is a torsion spring and includes an end loop 124 at its upper end and an end loop 125 at its lower end (end loop 125 seen in FIG. 7). As is also seen in FIG. 7, end loop 125 at the bottom of spring 123 is captivated within a channel 140 of lower body 26.

Returning to FIG. 5, a clutch member 126, the structure of which is set forth below in FIG. 6 in greater detail, is secured to shaft 120 by a coupler 127. Thus, clutch member 126 is securely attached to shaft 120 and rotatable therewith. Clutch member 126 includes a downwardly extending post 128 which is received within end loop 124 of spring 123. A clutch housing 130 is received upon clutch member 126 and engages clutch member 126 in the manner set forth below in FIG. 6. Clutch housing 130 is secured to flange 30 of torso 12 by the extension of rib 132 of clutch housing 130 into a notch 133 formed in flange 130 in the manner shown in FIG. 6. Suffice it to note here that clutch housing 130 is securely joined to torso 12 while clutch member 126 is rotatably supported upon shaft 120. Thus, rotational force may only be coupled between shaft 120 as it rotates in the manner described below to torso 12 to the extent that clutch housing 130 remains engaged with clutch member 126.

Legs 13 and 14 are pivotally secured to lower body 26 by posts 102 and 103 having heads 104 and 105 respectively. Post 102 is received within aperture 100 while head 104 is positioned inside aperture 112. Similarly, post 103 is received within aperture 101 while head 105 is positioned inside of aperture 113. As a result, legs 13 and 14 are pivotally secured to lower body 26.

In operation and assuming initially that doll 10 is in its relaxed position, the majority of pullstring 32 is drawn into lower body 26 in the manner seen in FIG. 2 and forms the wound portion 122 upon spool 121. Thereafter, as the user initially draws pullstring 32 (seen in FIG. 2) outwardly from lower body 26, the quantity of wound pullstring 122 upon spool 121 begins unwinding which in turn rotates spool 121. Recalling that spool 121 is secured to shaft 120, it will be seen that the rotation of shaft 120 produces a corresponding rotation of clutch member 126. At this point, it should be noted that in the manner shown in FIG. 7, the lower end of spring 123 is maintained in a fixed position. Returning to FIG. 5, it will be noted that the rotation of clutch member 126 caused by the rotation of shaft 120 also rotates the upper end of spring 123 due to the attachment between post 128 of clutch member 126 and end loop 124 of spring 123.

Assuming that clutch member 126 and clutch housing 130 remained engaged, the rotation of clutch member 126 produces a corresponding rotation of clutch housing 130. Because clutch housing 130 is joined to torso 12, a corresponding rotation of torso 12 is produced.

Thus, as pullstring 32 (seen in FIG. 2) continues to be drawn outwardly unwinding spool 121, spring 123 is wound and torso 12 is rotated. Once the maximum quantity of pullstring has been drawn from spool 121 and spring 123 has been correspondingly wound storing energy therein, the lessening of the drawing pressure imparted to the pullstring by the user allows spring 123 to begin rewinding the pullstring upon spool 121. This return rotation is opposite in direction to the initial rotation produced by drawing the pullstring and is produced as spring 123 releases the stored energy therein. The user may choose to completely release the pullstring allowing a fast return rotation of torso 12 or, alternatively, may slow the rotation by holding the pullstring back slightly and resisting the return force of spring 123. In either event, the result is that the energy within spring 123 stored during the pullstring drawing process is released to return the spring to its natural through multiple rotations of torso 12.

The function of clutch member 126 and clutch housing 130 is set forth below in FIG. 6 in greater detail. Suffice it to note here that a protection against over stressing of the operative mechanism is provided in that the coupling between clutch member 126 and clutch housing 130 is released in the event excessive forces are coupled therebetween. Thus, for example, should the child user grasp torso 12 and pull excessively on the pullstring of doll 10, the otherwise destructive force is released through the disengagement of clutch member 126 with clutch housing 130.

Figure 6:
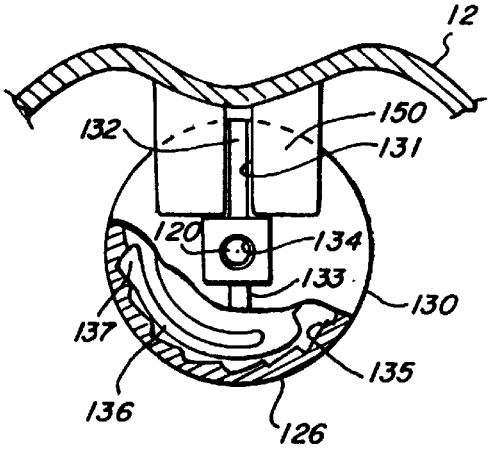
FIG. 6 sets forth a partial section top view of the clutch mechanism of the present invention twirling doll taken along section lines 6—6 in FIG. 5.

FIG. 6 sets forth a partial section view showing the operation of clutch member 126 and clutch housing 130. As mentioned above, clutch housing 130 is secured to torso 12 by a flange 150. More specifically, clutch housing 130 includes a pair of outwardly extending ribs 132 and 133. Clutch housing 30 also defines an aperture 134 through which shaft 120 passes.

Flange 150 of torso 12 defines a notch 131 which receives rib 32 to maintain a direct attachment between clutch housing 130 and torso 12. Clutch member 126 defines a plurality of internal teeth 135. Correspondingly, clutch housing 130 includes an elongated clutch spring 136 having a tooth 137 at the outer end thereof. The force of clutch spring 36 forces tooth 137 into engagement with the adjacent one of teeth 135. As a result under normal force coupling, the rotation imparted to clutch member 126 described below is communicated to clutch housing 130 by the engagement of tooth 137 with teeth 135. This rotational engagement in turn causes clutch housing 130 to rotate torso 12 due to the coupling between rib 132 and flange 150. In the event of excessive resistance of torso 12, however, the angled character of teeth 135 and tooth 137 overcome the force of clutch spring 136 allowing tooth 137 to slip past teeth 135 and causing disengagement between clutch 126 and clutch housing 130. Under normal circumstances, however, the coupling between clutch member 126 and clutch housing 130 is constant and produces a corresponding rotation of torso 12.

FIG. 7 sets forth a section view of doll 10 taken along section lines 7—7 in FIG. 5. As described above, doll 10 includes a lower body 126 having an eyelet 138 defining an aperture 27 therein. Legs 13 and 14 are secured to lower body 26. As is also described above, a spool 121 is rotatably supported upon a shaft 120 together with a spring 123. Lower body 26 further defines a channel 140 within which end loop 125 at the bottom end of spring 123 is captivated. The captivation of end loop 125 within channel 140 maintains the coupling between spring 123 and lower body 26 described above. Thus, for both directions of torque of spring 123, the spring force is applied to lower body 26 due to end loop 125 engaging channel 140. As pullstring 32 is drawn from and rewound upon spring 121, the corresponding torsional forces of spring 123 are imparted at one end to lower body 26.

What has been shown is a novel twirling doll having an upper body and arms which are rotatable with respect to the lower body. The doll includes a pullstring mechanism for rotating or twirling the upper portion of the doll body. Each arm is equipped with a bubble-producing attachment which allows a novel play pattern to be undertaken by the child user. Repeated pulling and releasing of the pullstring mechanism following proper loading of the bubble-producing liquid upon the bubble attachments causes the doll to exhibit a novel bubble-producing play activity. The mechanism is simple to use and may be readily mastered by even the youngest of children.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll comprising:

a lower body;

a torso rotatably coupled to said lower body;

a pair of arms supported by said torso;

a pair of bubble attachments, each having a bubble ring defining an aperture, said bubble attachments supported by said pair of arms;

means for rotating said torso, said arms and said bubble attachments relative to said lower body, said bubble attachments being configured to carry a quantity of bubble-producing liquid and to create bubbles as air passes over them.

2. The doll set forth in claim 1 wherein each of said bubble attachments includes means for its removable securing.

3. The doll set forth in claim 2 wherein said means for rotating includes a pullstring drive mechanism having a pullstring with one end wound upon a spool and a return spring for rewinding said pullstring.

4. The doll set forth in claim 3 wherein said arms each include a wrist and wherein said bubble attachments each include a resilient clasp supporting one of said bubble rings, said resilient clasp being snap-fit attachable to one of said wrists.

5. The doll set forth in claim 4 wherein said arms are pivotally secured to said torso.

6. The doll set forth in claim 5 wherein said pullstring drive includes means for rotating said torso in a first direction as said pullstring is drawn outwardly from said doll body and for rotating said torso in a second opposite direction as said pullstring is rewound under the force of said return spring.

7. A doll comprising:

a doll body having a torso and arms and a lower body rotatably coupled thereto;

means for rotating said torso and arms relative to said lower body; and at least one bubble producing attachment supported by at least one of said arms, said at least one bubble producing attachment producing bubbles as said means for rotating rotates said torso, said at least one arm and said at least one bubble producing attachment.

8. The doll set forth in claim 7 wherein said means for rotating includes a pullstring drive mechanism having a pullstring with one end wound upon a spool and a return spring for rewinding said pullstring.

9. The doll set forth in claim 8 wherein said arms include a pair of arms and wherein said at least one bubble-producing attachment are at least a pair of bubble-producing attachments.

10. The doll set forth in claim 9 wherein said arms each include a wrist and wherein said bubble attachments each include a resilient clasp supporting a bubble ring, said resilient clasp being snap-fit attachable to one of said wrists.

11. The doll set forth in claim 10 wherein said arms are pivotally secured to said torso.

12. The doll set forth in claim 11 wherein said pullstring drive includes means for rotating said torso in a first direction as said pullstring is drawn outwardly from said doll body and for rotating said torso in a second opposite direction as said pullstring is rewound under the force of said return spring.

* * * * *